US007096842B2

(12) United States Patent
Lin et al.

(10) Patent No.: US 7,096,842 B2
(45) Date of Patent: Aug. 29, 2006

(54) ROPE-OPERATED ACTUATOR FOR AN ENGINE STARTER

(75) Inventors: Tsang-Mao Lin, Kaohsiung (TW); Jui-Tien Chen, Kaohsiung (TW); Cheng-Sheng Tsai, Kaohsiung (TW)

(73) Assignee: Kwang Yang Motor Co. Ltd., Kaohsiung (TW)

( * ) Notice: Subject to any disclaimer, the term of this patent is extended or adjusted under 35 U.S.C. 154(b) by 57 days.

(21) Appl. No.: 10/963,463

(22) Filed: Oct. 12, 2004

(65) Prior Publication Data

US 2006/0075985 A1 Apr. 13, 2006

(51) Int. Cl.
*F02N 3/02* (2006.01)

(52) U.S. Cl. ..... 123/185.3; 74/7 C; 192/42

(58) Field of Classification Search ..... 123/185.2, 123/185.3, 185.4

See application file for complete search history.

(56) References Cited

U.S. PATENT DOCUMENTS 2,848,987 A * 8/1958 Morden ..... 123/185.4

* cited by examiner

*Primary Examiner*—Andrew M. Dolinar
(74) *Attorney, Agent, or Firm*—Frommer Lawrence & Haug LLP; Ronald R. Santucci

(57) ABSTRACT

A rope-operated actuator for an engine starter includes a cover with a shaft, a spool wheel sleeved rotatably on the shaft, a rope connected to the spool wheel for driving the spool wheel, a rope-rewinding member for rewinding the rope on the spool wheel, a pawl-driving member mounted on the shaft, a pair of pawls disposed between the spool wheel and the pawl-driving member and pivotable between engaging and disengaging positions, a wobble-preventing member mounted on the shaft and extending radially and outwardly therefrom, and a retaining member connected to the shaft for retaining the spool wheel, the pawl-driving member and the wobble-preventing member on the shaft.

4 Claims, 11 Drawing Sheets

ROPE-OPERATED ACTUATOR FOR AN ENGINE STARTER

BACKGROUND OF THE INVENTION

1. Field of the Invention

This invention relates to a rope-operated actuator, more particularly to a rope-operated actuator for an engine starter of a lawn mower.

2. Description of the Related Art

FIGS. 1 to 5 illustrate a conventional rope-operated actuator for an engine starter 2 of a lawn mower 1. The conventional rope-operated actuator includes: a cover 11 formed with a central shaft 113; a spool wheel 12 mounted coaxially and rotatably on the central shaft 113; a spiral spring 122 disposed between the cover 11 and the spool wheel 12 and, having two opposite ends that are respectively secured to the cover 11 and the spool wheel 12; a rope 123 connected to the spool wheel 12 for driving the spool wheel 12 and extending through a hole 112 in the cover 11, the rope 123 being rewindable around the spool wheel 12 through the spiral spring 122, and being provided with a handle 14; a pawl-driving disc 13 disposed at one side of the spool wheel 12 opposite to the cover 11 and formed with two opposite guiding grooves 136; a pair of diametrically disposed pawls 131 disposed between the spool wheel 12 and the pawl-driving disc 13, pivoted to the spool wheel 12, co-rotatable with the spool wheel 12, and pivotable relative to the spool wheel 12 between engaging and disengaging positions, each of the pawls 131 extending in a radial direction relative to the spool wheel 12, and being formed with a stud 135 that extends in the axial direction into a respective one of the guiding grooves 136 (see FIG. 4) so as to permit the pawls 131 to be driven by the pawl-driving disc 13 to pivot relative to the spool wheel 12 from the disengaging position to the engaging position when the spool wheel 12 is rotated together with the pawls 131 in a first rotational direction, and from the engaging position to the disengaging position when the spool wheel 12 is rotated together with the pawls 131 in a second rotational direction opposite to the first rotational direction; a pair of diametrically disposed coil springs 133, each of which is disposed between the spool wheel 12 and a respective one of the pawls 131 and each of which urges the respective one of the pawls 131 to abut against the pawl-driving disc 13; and a screw rod 134 extending through the pawl-driving disc 13 to engage threadedly the central shaft 113 for retaining the pawl-driving disc 13 thereon and for retaining the spool wheel 12 on the central shaft 113. The pawls 131 engage releasably a flywheel 21 of the engine starter 2 when the pawls 131 are moved to the engaging position upon pulling of the rope 123, thereby permitting co-rotation of the fly wheel 21 and the spool wheel 12. The cover 11 is further formed with a spring-securing part 115 that is disposed adjacent to the central shaft 113 for retaining one end of the spiral spring 122. The spool wheel 12 has a ring that is formed with a spring-retaining recess 124 (see FIG. 3) for retaining the other end of the spiral spring 122.

The conventional rope-operated actuator is disadvantageous in that since the pawl-driving disc 13, which abuts against the pawls 131 through the urging action of the coil springs 133, is only sleeved around the screw rod 134, the pawl-driving disc 13 tends to wobble due to the urging action of the coil springs 133 during rotation of the spool wheel 12, which can result in undesired movement of the studs 135 of the pawls 131 to the outside of the guiding grooves 136, which, in turn, results in movement of the pawls 131 to an undesired position. As a consequence, the engine starter 2 may be unable to function smoothly. In addition, mounting of the coil springs 133 between the spool wheel 12 and the pawls 131 is relatively inconvenient and difficult, which can result in an increase in manufacturing costs. Moreover, the spiral spring 122 is required to be deformed and reduced in size prior to installation between the cover 11 and the spool wheel 12, which is laborious and inconvenient during assembly. Furthermore, the position of the rope 123 tends to deviate from a tangential direction relative to the spool wheel 12 (see FIG. 5) during a pulling operation, which can result in wearing of the rope 123 and cause difficulty in pulling the rope 123.

SUMMARY OF THE INVENTION

Therefore, the object of this invention is to provide a rope-operated actuator with a wobble-preventing member that is capable of stabilizing the aforesaid pawl-driving disc and preventing wobbling of the pawl-driving disc when the pawls co-rotate with a spool wheel from a disengaging position to an engaging position.

According to the present invention, a rope-operated actuator for an engine starter is provided. The rope-operated actuator comprises: a cover formed with a central shaft that defines a rotation axis; a spool wheel mounted coaxially and rotatably on the central shaft; a rope-rewinding member disposed between the cover and the spool wheel; a rope connected to the spool wheel and extending outwardly therefrom for driving the spool wheel to rotate about the rotation axis, the rope being rewindable around the spool wheel through the rope-rewinding member; a pawl-driving member mounted coaxially and rotatably on the central shaft, and having a first side face that faces toward the spool wheel and that is formed with two opposite guiding grooves, and a second side face that is opposite to the first side face; an urging member sleeved on the central shaft and abutting against the pawl-driving member for urging the pawl-driving member to move in an axial direction relative to the rotation axis away from the spool wheel; a pair of diametrically disposed pawls disposed between the spool wheel and the pawl-driving member, pivoted to the spool wheel, co-rotatable with the spool wheel, and pivotable relative to the spool wheel between engaging and disengaging positions, each of the pawls extending in a radial direction relative to the spool wheel, and being formed with a stud that extends in the axial direction into a respective one of the guiding grooves so as to permit the pawls to be driven by the pawl-driving member to pivot relative to the spool wheel from the disengaging position to the engaging position when the spool wheel is rotated together with the pawls about the rotation axis in a first rotational direction, and from the engaging position to the disengaging position when the spool wheel is rotated together with the pawls about the rotation axis in a second rotational direction opposite to the first rotational direction; a wobble-preventing member mounted coaxially on and extending radially and outwardly from the central shaft, and in contact with the second side face of the pawl-driving member; and a retaining member connected to the central shaft for retaining the spool wheel, the pawl-driving member, and the wobble-preventing member on the central shaft in such a manner to permit the second side face of the pawl-driving member to abut against the wobble-preventing member by virtue of urging action of the urging member and to permit the studs of the pawls to be retained in the guiding grooves in the pawl-driving member.

BRIEF DESCRIPTION OF THE DRAWINGS

Other features and advantages of the present invention will become apparent in the following detailed description of the preferred embodiment of the invention, with reference to the accompanying drawings. In the drawings.

DETAILED DESCRIPTION OF THE PREFERRED EMBODIMENT

Figure 1:
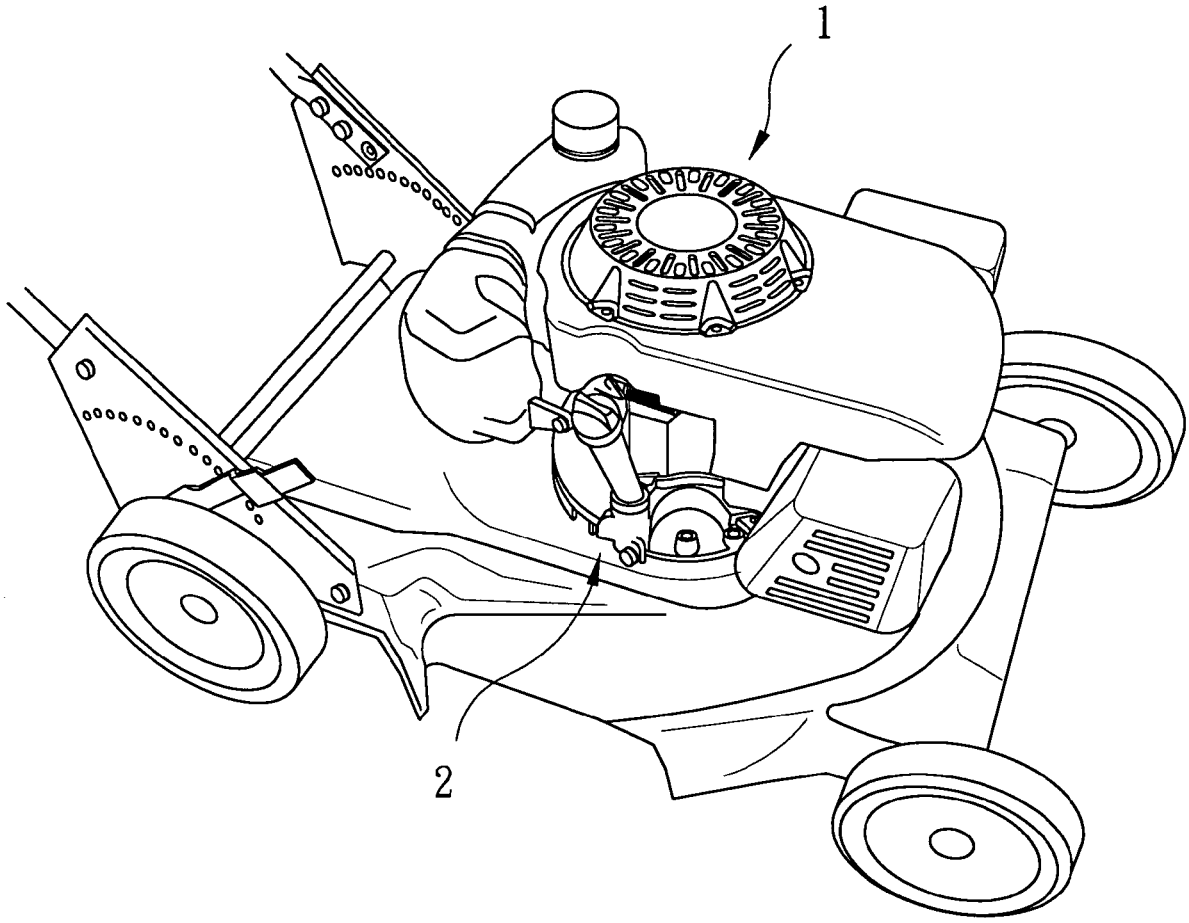
FIG. 1 PRIOR ART
FIG. 1 is a perspective view of a lawn mower with a conventional rope-operated actuator.
Figure 2:
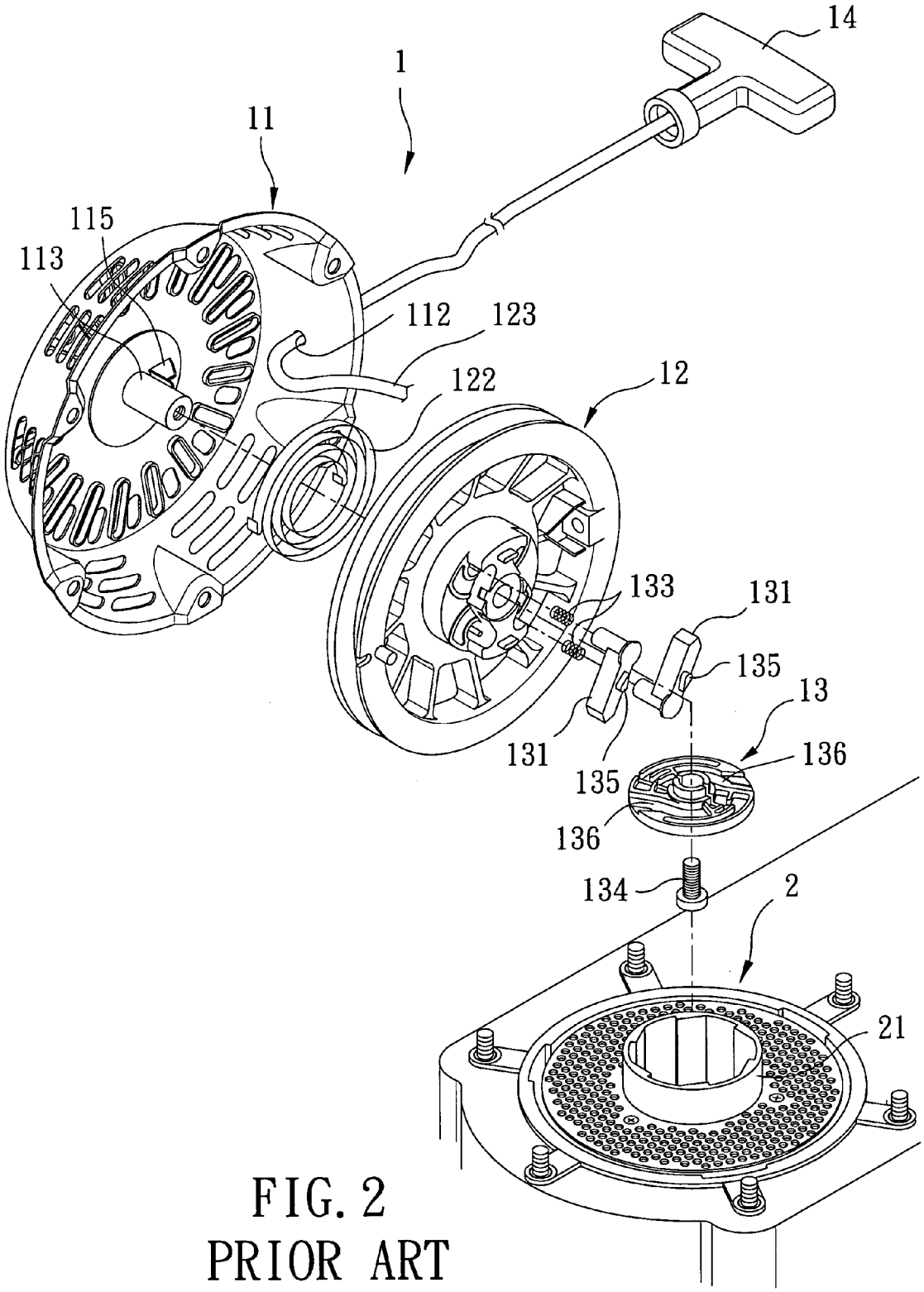
FIG. 2 PRIOR ART
FIG. 2 is an exploded perspective view of the conventional rope-operated actuator.
Figure 3:
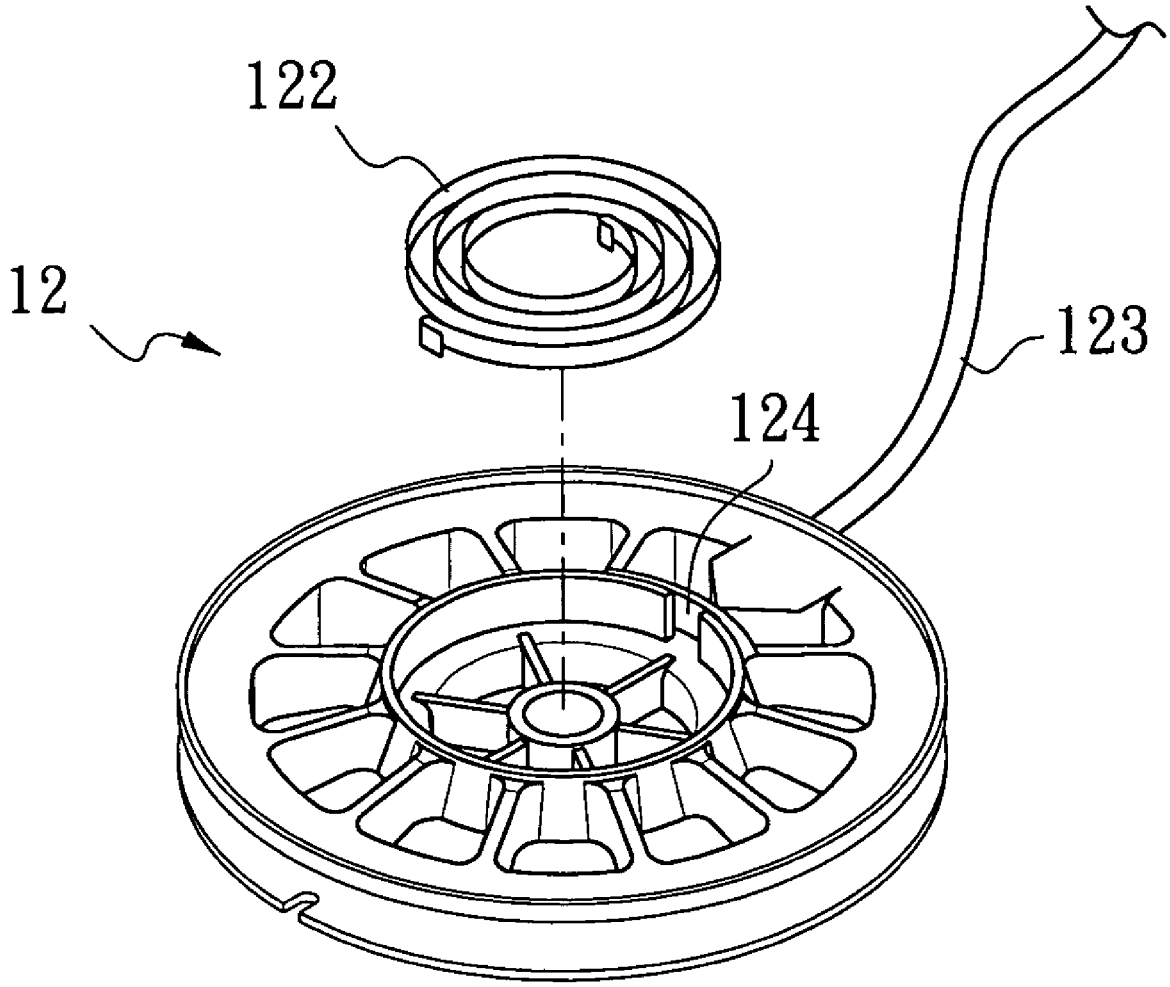
FIG. 3 PRIOR ART
FIG. 3 is an exploded perspective view of an assembly of a spool wheel and a spiral spring of the conventional rope-operated actuator.
Figure 4:
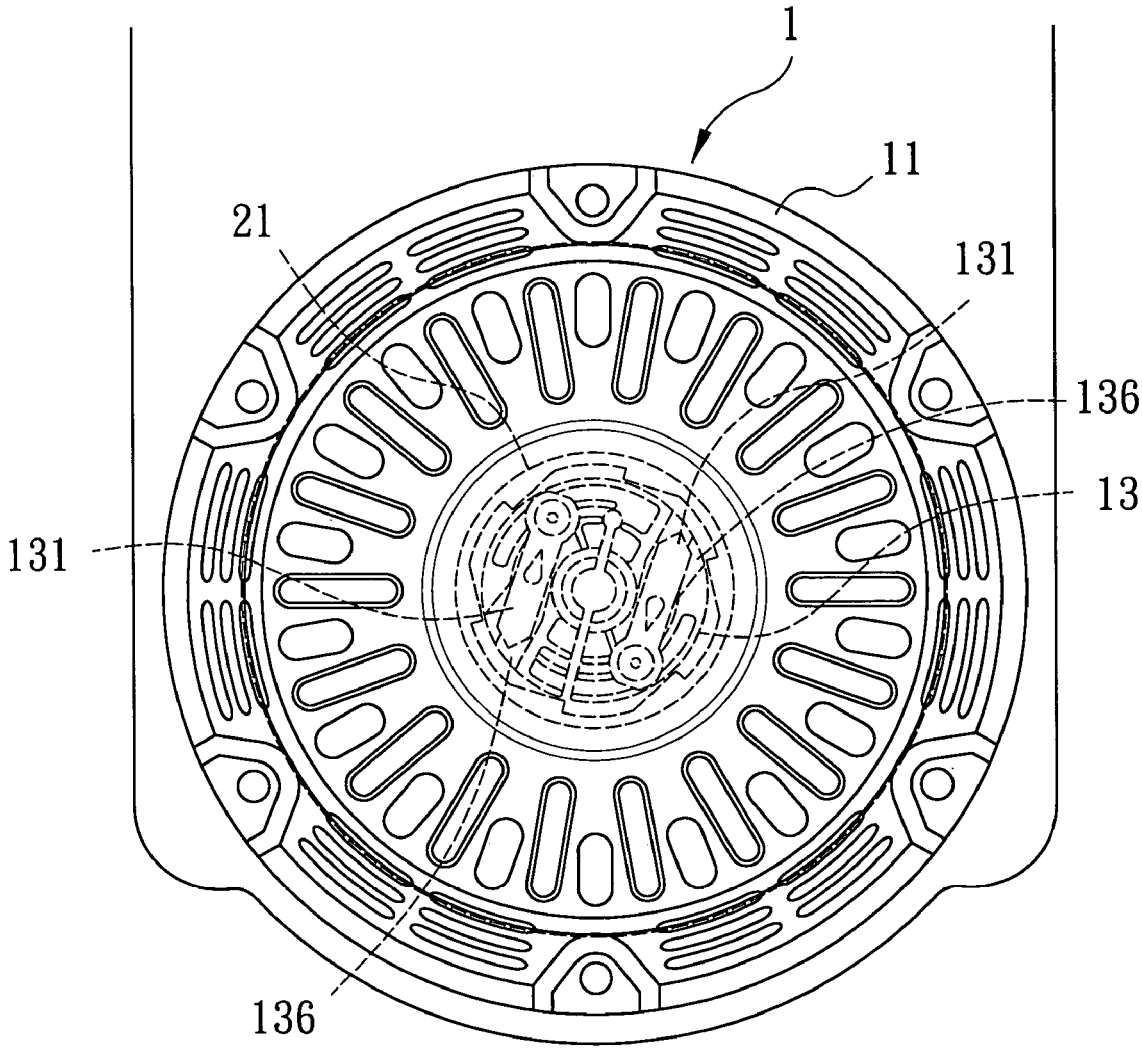
FIG. 4 PRIOR ART
FIG. 4 is a fragmentary top view to illustrate engagement between pawls and guiding grooves in a pawl-driving disc of the conventional rope-operated actuator.
Figure 5:
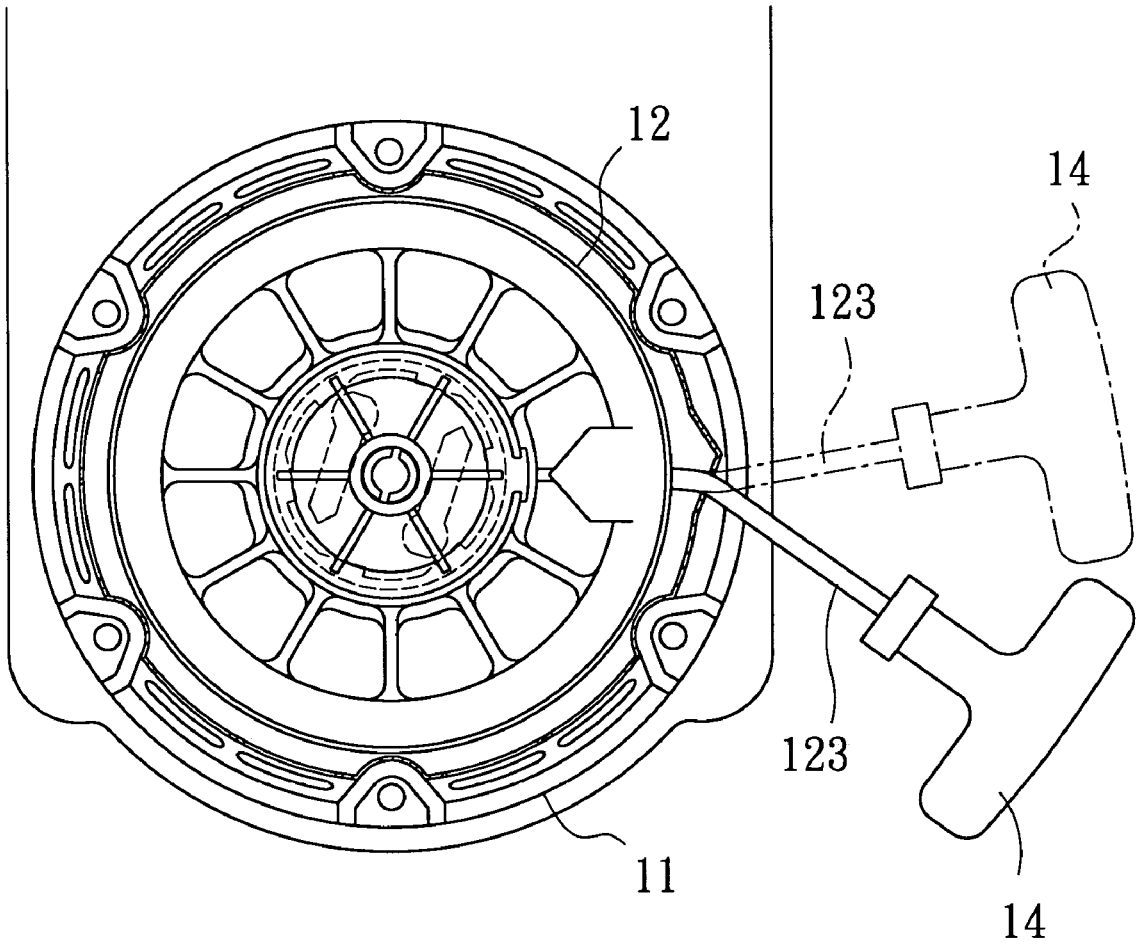
FIG. 5 PRIOR ART
FIG. 5 is a fragmentary top view to illustrate how a rope of the conventional rope-operated actuator tends to deviate from a tangential direction when pulled.
Figure 6:
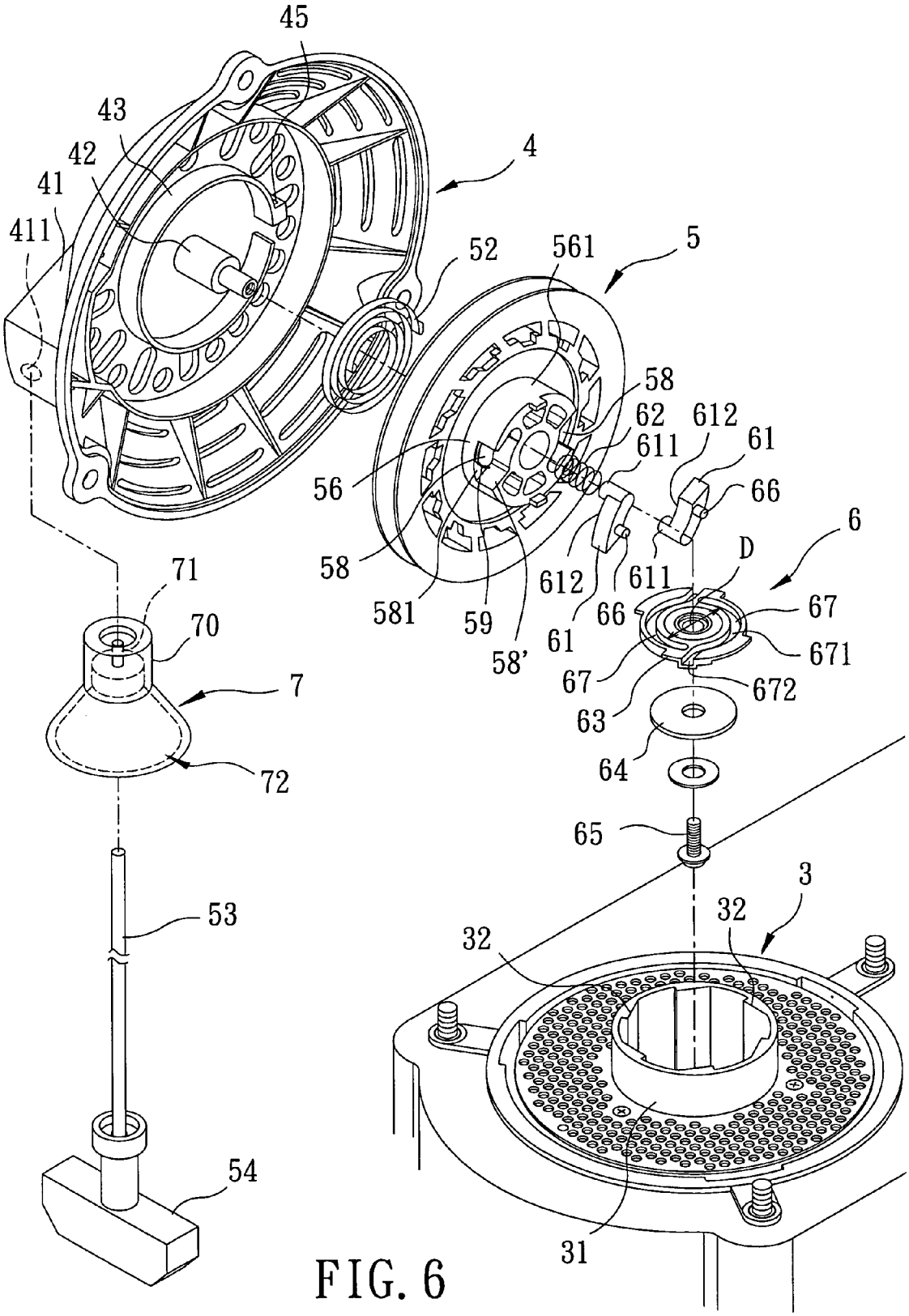
FIG. 6 is an exploded perspective view of the preferred embodiment of a rope-operated actuator according to this invention.
Figure 7:
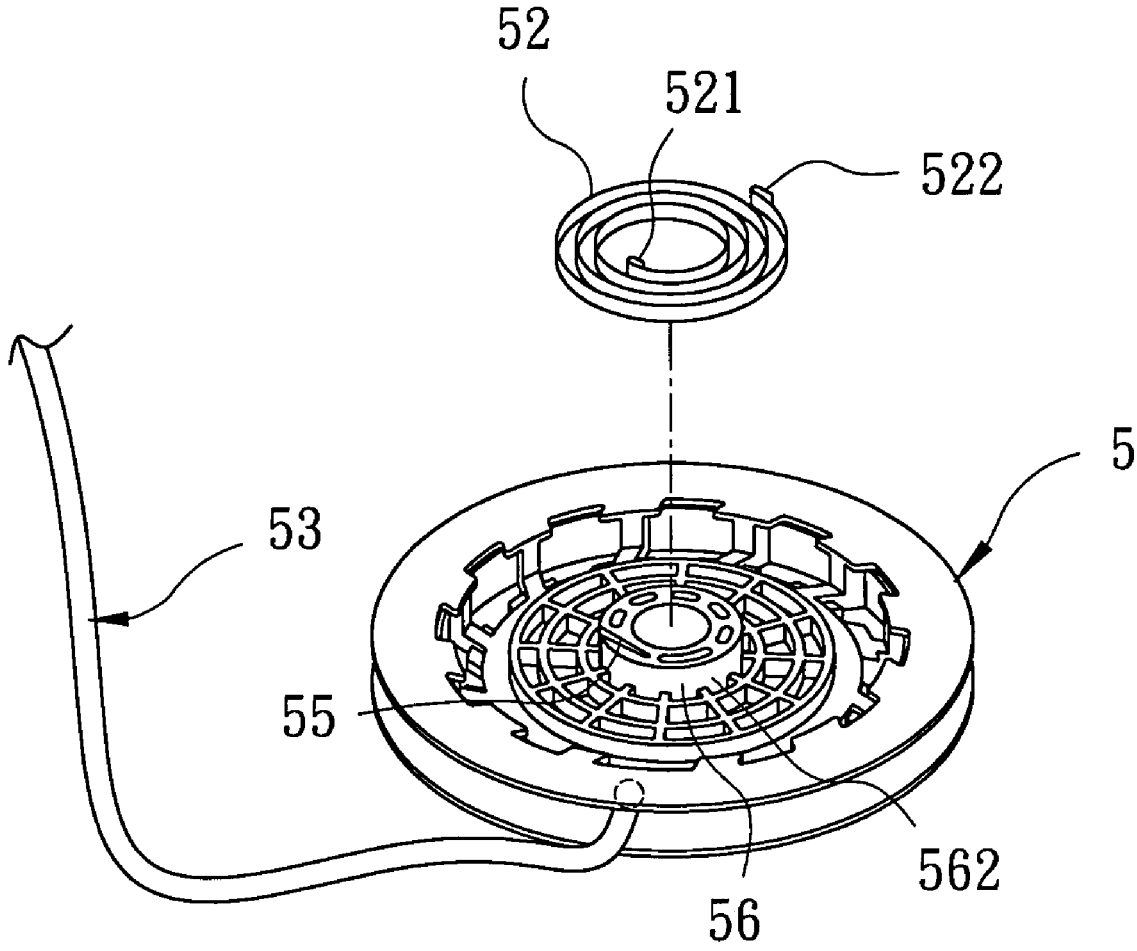
FIG. 7 is an exploded perspective view to illustrate how a spiral spring is mounted on a spool wheel of the preferred embodiment.

FIGS. 6 and 7 illustrate the preferred embodiment of a rope-operated actuator for an engine starter of a lawn mower (not shown) according to this invention.

Figure 8:
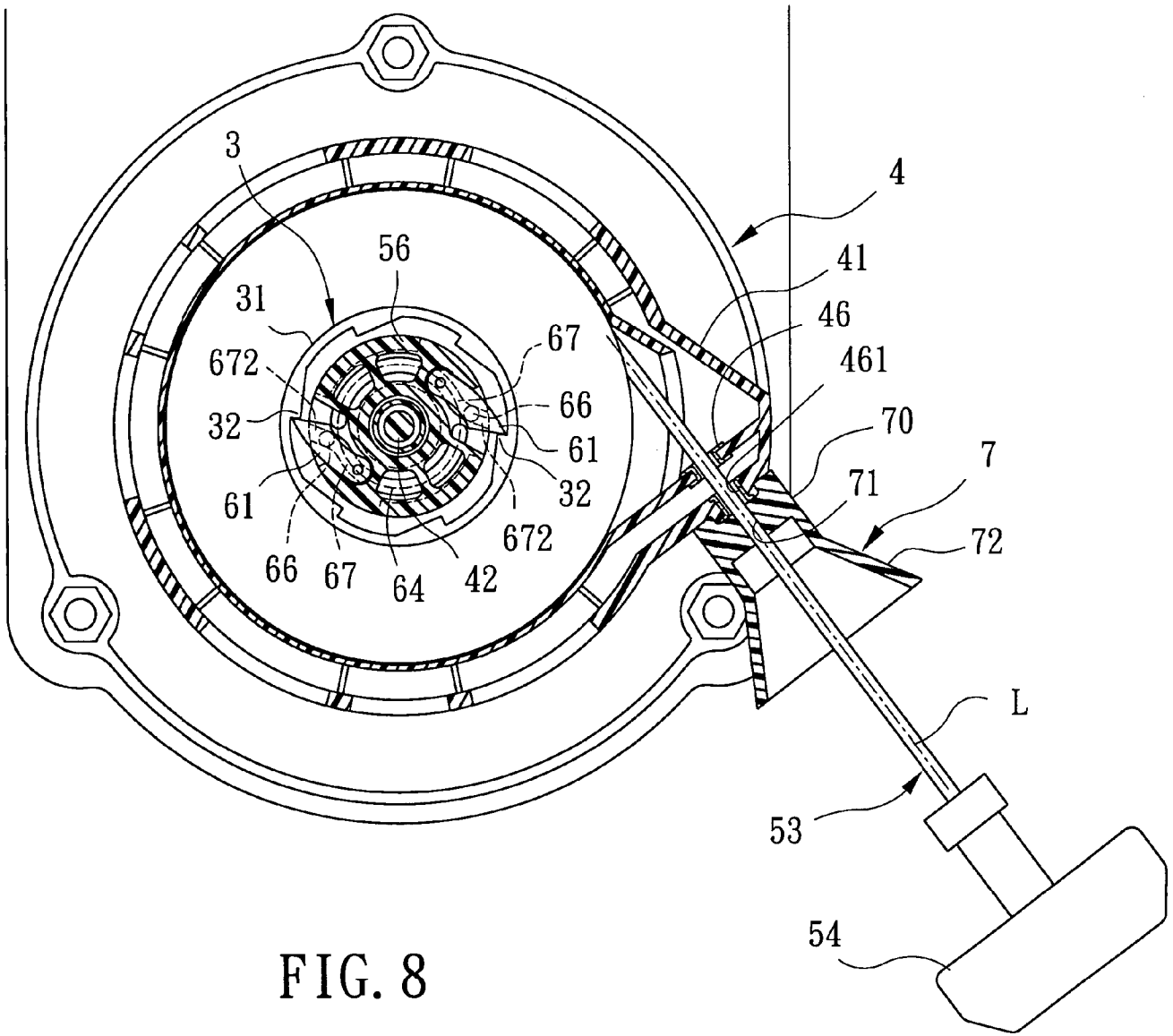
FIG. 8 is a sectional view illustrating the preferred embodiment in a state where pawls are moved to an engaging position to engage a flywheel of an engine starter upon pulling of a rope away from a spool wheel.
Figure 9:
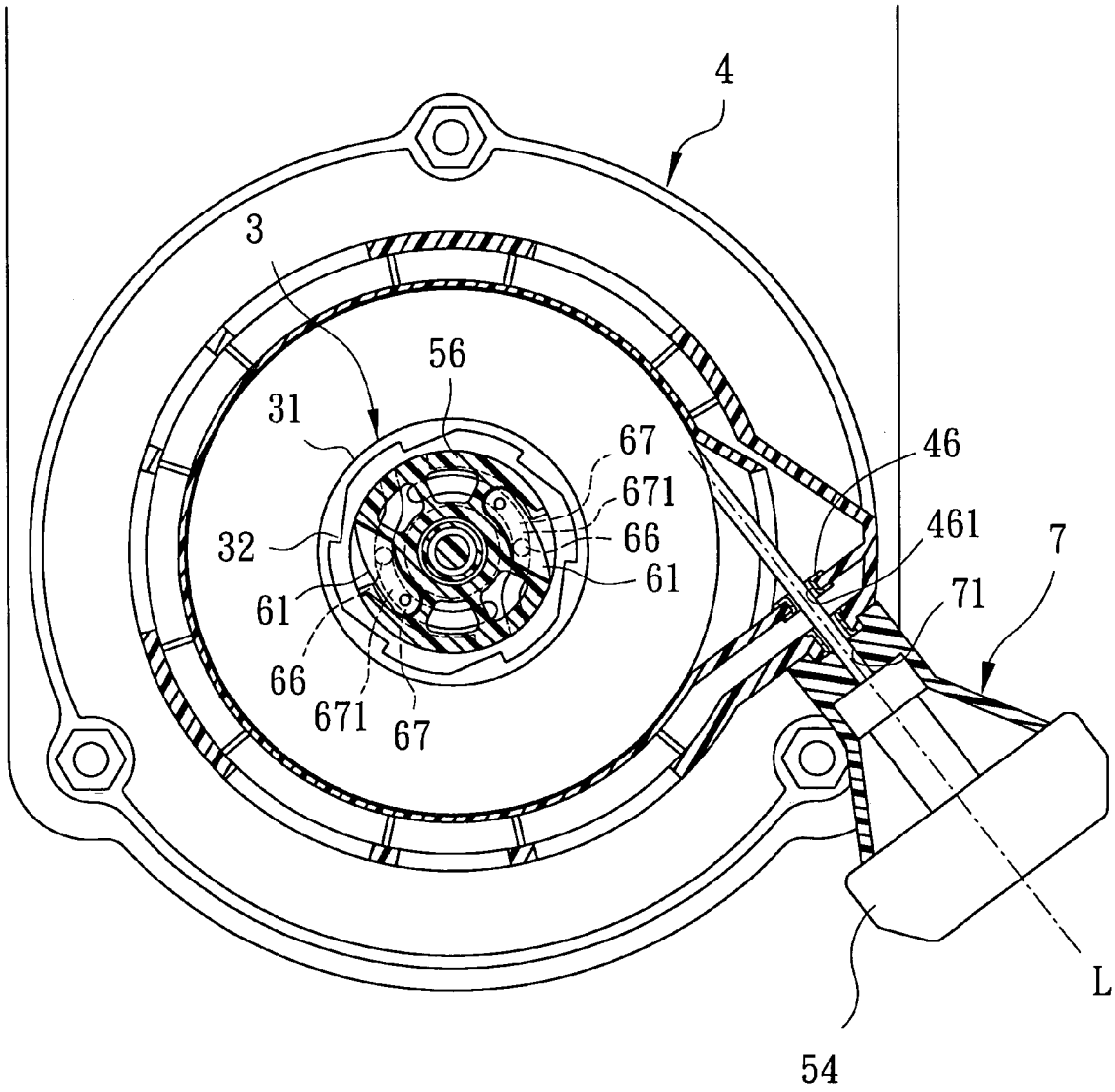
FIG. 9 is a sectional view illustrating the preferred embodiment in a state where the pawls are moved to a disengaging position to disengage the flywheel upon releasing of the rope and subsequent rewinding of the rope on the spool wheel through the spiral spring.

The rope-operated actuator includes: a cover 4 formed with a central shaft 42 that defines a rotation axis; a spool wheel 5 mounted coaxially and rotatably on the central shaft 42; a rope-rewinding member 52 disposed between the cover 4 and the spool wheel 5; a rope 53 connected to the spool wheel 5 and extending outwardly therefrom for driving the spool wheel 5 to rotate about the rotation axis, the rope 53 being rewindable around the spool wheel 5 through the rope-rewinding member 52; a pawl-driving member 6 mounted coaxially and rotatably on the central shaft 42, and having a first side face that faces toward the spool wheel 5 and that is formed with two opposite guiding grooves 67, and a second side face that is opposite to the first side face; an urging member 62 sleeved on the central shaft 42 and abutting against the pawl-driving member 6 for urging the pawl-driving member 6 to move in an axial direction relative to the rotation axis away from the spool wheel 5; a pair of diametrically disposed pawls 61 disposed between the spool wheel 5 and the pawl-driving member 6, pivoted to the spool wheel 5, co-rotatable with the spool wheel 5, and pivotable relative to the spool wheel 5 between engaging and disengaging positions (see FIGS. 8 and 9), each of the pawls 61 extending in a radial direction relative to the spool wheel 5, and being formed with a stud 66 that extends in the axial direction into a respective one of the guiding grooves 67 so as to permit the pawls 61 to be driven by the pawl-driving member 6 to pivot relative to the spool wheel 5 from the disengaging position to the engaging position when the spool wheel 5 is rotated together with the pawls 61 about the rotation axis in a first rotational direction, and from the engaging position to the disengaging position when the spool wheel 5 is rotated together with the pawls 61 about the rotation axis in a second rotational direction opposite to the first rotational direction; a wobble-preventing member 64 mounted coaxially on and extending radially and outwardly from the central shaft 42, and in contact with the second side face of the pawl-driving member 6; and a retaining member 65 connected to the central shaft 42 for retaining the spool wheel 5, the pawl-driving member 6, and the wobble-preventing member 64 on the central shaft 42 in such a manner to permit the second side face of the pawl-driving member 6 to abut against the wobble-preventing member 64 by virtue of urging action of the urging member 62 and to permit the studs 66 of the pawls 61 to be retained in the guiding grooves 67 in the pawl-driving member 6. In this embodiment, the retaining member 65 is a screw rod that engages threadedly an inner thread of the central shaft 42.

The pawls 61 respectively engage two diametrically disposed teeth 32 on a flywheel 31 of the engine starter 3 of the lawn mower when the pawls 61 are disposed at the engaging position.

In this embodiment, the pawl-driving member 6 is in the form of a circular plate, and has a peripheral edge 63. Each of the guiding grooves 67 in the pawl-driving member 6 has a circumferentially extending section 671 and a curved driving section 672 that extends from the circumferentially extending section 671 to the peripheral edge 63 of the pawl-driving member 6. The circumferentially extending sections 671 of the guiding grooves 67 complement each other to form a circle-like groove that defines an inner diameter (D). The wobble-preventing member 64 is in the form of a circular plate, and has a diameter greater than the inner diameter (D) of the circle-like groove defined by the circumferentially extending sections 671 so as to prevent wobbling of the pawl-driving member 6 during rotation of the spool wheel 5 and movement of the pawls 61 along the circumferentially extending sections 671. The stud 66 of each of the pawls 61 is disposed in the circumferentially extending section 671 (see FIG. 9) of the respective one of the guiding grooves 67 when the respective one of the pawls 61 is disposed at the disengaging position, and is disposed in the curved driving section 672 (see FIG. 8) of the respective one of the guiding grooves 67 when the respective one of the pawls 61 is disposed at the engaging position.

In operation, when the spool wheel 5 starts to rotate in the first rotational direction upon pulling of the rope 53, the pawls 61 are driven by the spool wheel 5 to co-rotate therewith, and each of the studs 66 is moved along the circumferentially extending section 671 of the respective guiding groove 67 toward the curved driving section 672. The pawl-driving member 6 and the wobble-preventing member 64 remain stationary at this stage. The studs 66 are subsequently blocked by the pawl-driving member 6 immediately after the studs 66 are moved to the curved driving sections 672 of the respective guiding grooves 67, which results in pivoting movement of the pawls 61 relative to the spool wheel 5 from the disengaging position to the engaging position, and the pawl-driving member 6 and the wobble-preventing member 64 are subsequently driven by the studs 66 to co-rotate with the spool wheel 5 and the pawls 61. The process is reversed when the rope 53 is released, thereby rewinding the rope 53 on the spool wheel 5 and moving the pawls 61 from the engaging position to the disengaging position.

The spool wheel 5 is formed with a cylindrical body 56 that surrounds the central shaft 42 and that is formed with two opposite pawl-receiving grooves 58, each of which is defined by a groove-defining wall 58'. The groove-defining wall 58' has a base portion 581 that faces in the axial direction and that is formed with a pawl-sliding strip 59. Each of the pawls 61 is received in a respective one of the pawl-receiving grooves 58, and has a pivot end 611 that is pivoted to the base portion 581 of the groove-defining wall 58', and a sliding surface 612 that faces the base portion 581 of the groove-defining wall 58' and that is in sliding contact with the pawl-sliding strip 59 so as to reduce the friction between the pawls 61 and the base portions 581 of the groove-defining walls 58' of the pawl-receiving grooves 58 during sliding movement of the pawls 61 between the engaging and disengaging positions when the spool wheel 5 is rotated.

Figure 10:
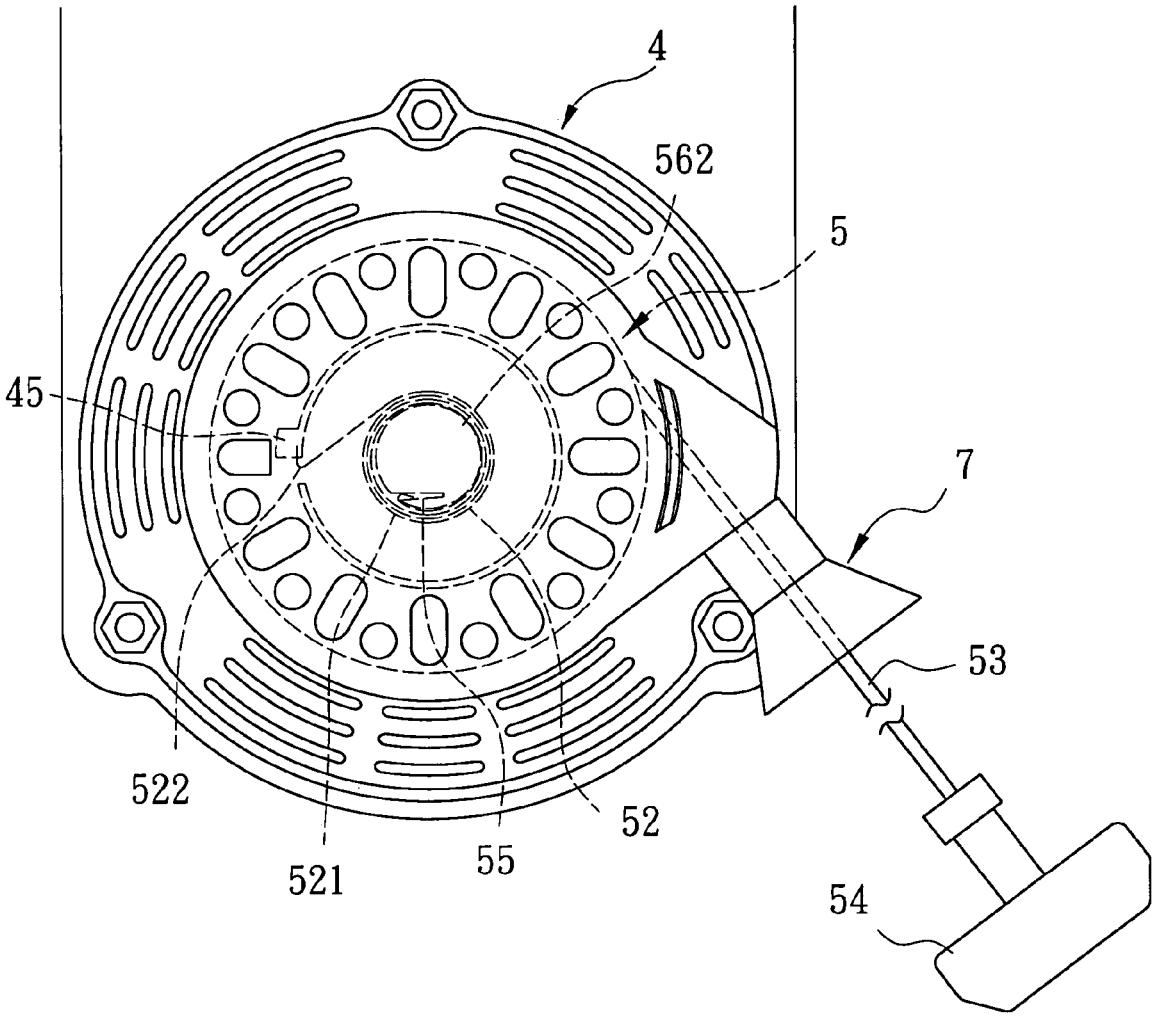
FIG. 10 is a fragmentary top view illustrating the spiral spring of the preferred embodiment in a tensioned state when the rope is pulled away from the spool wheel.
Figure 11:
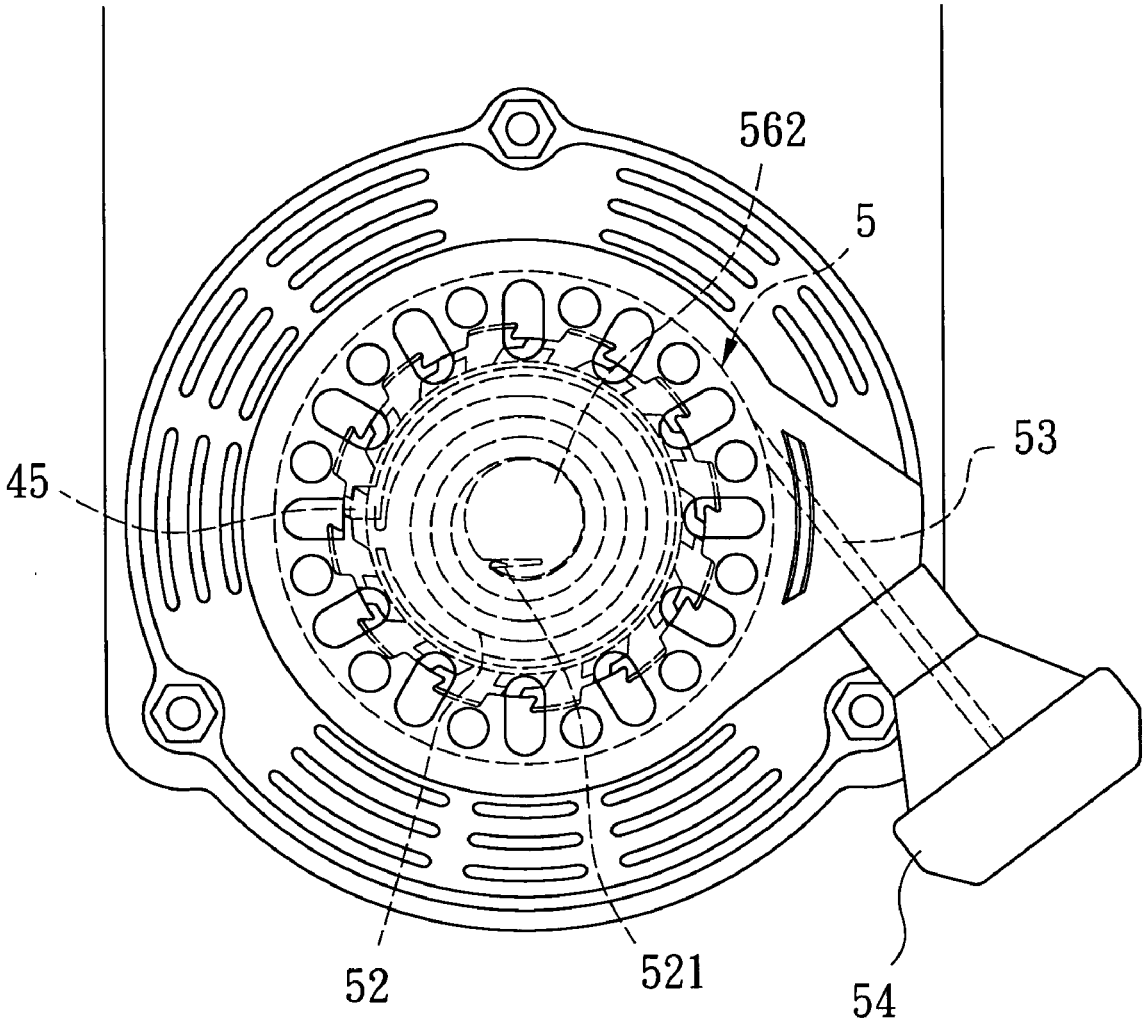
FIG. 11 is a fragmentary top view illustrating the spiral spring of the preferred embodiment in a normal state when the rope is released and is subsequently rewound on the spool wheel.

The spool wheel 5 has a cover side and a pawl side that is opposite to the cover side in the axial direction. The cylindrical body 56 has a first half 561 that protrudes axially from the pawl side, and a second half 562 (see FIG. 7) that protrudes axially from the cover side. The pawl-receiving grooves 58 are formed in the first half 561 of the cylindrical body 56. The second half 562 of the cylindrical body 56 is formed with a retaining recess 55. The cover 4 is further formed with a retaining ring 43 that surrounds the second half 562 of the cylindrical body 56, and a retaining protrusion 45 that protrudes radially and outwardly from the retaining ring 43. The rope-rewinding member 52 is in the form of a spiral spring, is disposed between the retaining ring 43 and the second half 562 of the cylindrical body 56, and has an inner end 521 (see FIGS. 7 and 10) that is secured to the retaining recess 55 in the second half 562 of the cylindrical body 56, and an outer end 522 that is secured to the retaining protrusion 45 of the cover 4. FIG. 10 illustrates the rope-rewinding member 52 when tensioned to accumulate a restoring force after the rope 53 is pulled away from the spool wheel 5. FIG. 11 illustrates the rope-rewinding member 52 when restored to its normal state to rewind the rope 53 on the spool wheel 5 after the rope 53 is released.

The cover 4 has a connecting part 41 that is formed with a rope-confining member 46 (see FIG. 8) which defines a first rope-directing channel 461 having an outlet end 411 (see FIG. 6). A rope-guiding member 7 includes a hollow cylindrical part 70 and a frusto-conical part 72 that extends and that diverges outwardly from the hollow cylindrical part 70. The hollow cylindrical part 70 is connected to the connecting part 41 of the cover 4, and defines a second rope-directing channel 71 (see FIG. 8) that is in spatial communication with the outlet end 411 of the first rope-directing channel 461 and that is aligned with the first rope-directing channel 461 so as to cooperate with the first rope-directing channel 461 to form a continuous rope-guiding channel that extends in a tangential direction (L) relative to the spool wheel 5 so as to prevent deviation of the rope 53 from the tangential direction (L) during pulling of the rope 53 (see FIG. 9). A T-shaped handle 54 is secured to an end of the rope 53, and has a shank portion extending into the frusto-conical part 72 of the rope-guiding member 7.

With the inclusion of the wobble-preventing member 64 in the rope-operated actuator of this invention, the aforesaid drawback with respect to undesired movement of the studs of the pawls to the outside of guiding grooves in the pawl-driving member of the conventional rope-operated actuator during starting of the engine starter of the lawn mower can be eliminated. In addition, with the inclusion of the rope-guiding member 7 in the rope-operated actuator of this invention, the aforesaid drawback with respect to the tendency of the rope to deviate from the tangential direction relative to the spool wheel during pulling of the rope can also be eliminated. Moreover, the design of the retaining recess 521 in the second half 562 of the cylindrical body 56 of the spool wheel 5 and the retaining protrusion 45 on the retaining ring 43 of the cover 4 permits easy mounting of the rope-rewinding member 52 thereon.

While the present invention has been described in connection with what is considered the most practical and preferred embodiment, it is understood that this invention is not limited to the disclosed embodiments but is intended to cover various arrangement included within the spirit and scope of the broadest interpretations and equivalent arrangements.

We claim:

1. A rope-operated actuator for an engine starter, comprising:

a cover formed with a central shaft that defines a rotation axis;

a spool wheel mounted coaxially and rotatably on said central shaft;

a rope-rewinding member disposed between said cover and said spool wheel;

a rope connected to said spool wheel and extending outwardly therefrom for driving said spool wheel to rotate about said rotation axis, said rope being rewindable around said spool wheel through said rope-rewinding member;

a pawl-driving member mounted coaxially and rotatably on said central shaft and having a first side face that faces toward said spool wheel and that is formed with two opposite guiding grooves, and a second side face that is opposite to said first side face;

an urging member sleeved on said central shaft and abutting against said pawl-driving member for urging said pawl-driving member to move in an axial direction relative to said rotation axis away from said spool wheel;

a pair of diametrically disposed pawls disposed between said spool wheel and said pawl-driving member, pivoted to said spool wheel, co-rotatable with said spool wheel, and pivotable relative to said spool wheel between engaging and disengaging positions, each of said pawls extending in a radial direction relative to said spool wheel, and being formed with a stud that extends in said axial direction into a respective one of said guiding grooves so as to permit said pawls to be driven by said pawl-driving member to pivot relative to said spool wheel from said disengaging position to said engaging position when said spool wheel is rotated together with said pawls about said rotation axis in a first rotational direction, and from said engaging position to said disengaging position when said spool wheel is rotated together with said pawls about said rotation axis in a second rotational direction opposite to said first rotational direction;

a wobble-preventing member mounted coaxially on and extending radially and outwardly from said central shaft, and in contact with said second side face of said pawl-driving member; and a retaining member connected to said central shaft for retaining said spool wheel, said pawl-driving member, and said wobble-preventing member on said central shaft in such a manner to permit said second side face of said pawl-driving member to abut against said wobble-preventing member by virtue of urging action of said urging member and to permit said studs of said pawls to be retained in said guiding grooves in said pawl-driving member;

wherein said pawl-driving member is in the form of a circular plate and has a peripheral edge, each of said guiding grooves having a circumferentially extending section and a curved driving section that extends from said circumferentially extending section to said peripheral edge of said pawl-driving member, said circumferentially extending sections of said guiding grooves complementing to each other to form a circle-like groove that defines an inner diameter, said wobble-preventing member being in the form of a circular plate and having a diameter greater than said inner diameter of said circle-like groove defined by said circumferentially extending sections, said stud of each of said pawls being disposed in said circumferentially extending section of the respective one of said guiding grooves when the respective one of said pawls is disposed at said disengaging position, and being disposed in said curved driving section of the respective one of said guiding grooves when the respective one of said pawls is disposed at said engaging position.

2. The rope-operated actuator of claim 1, wherein said spool wheel is formed with a cylindrical body that surrounds said central shaft and that is formed with two opposite pawl-receiving grooves, each of which is defined by a groove-defining wall, said groove-defining wall having a base portion that faces in said axial direction and that is formed with a pawl-sliding strip, each of said pawls being received in a respective one of said pawl-receiving grooves, and having a pivot end that is pivoted to said base portion of said groove-defining wall, and a sliding surface that faces said base portion of said groove-defining wall and that is in sliding contact with said pawl-sliding strip.

3. The rope-operated actuator of claim 2, wherein said spool wheel has a cover side and a pawl side that is opposite to said cover side in said axial direction, said cylindrical body having a first half that protrudes from said pawl side, and a second half that protrudes from said cover side, said pawl-receiving grooves being formed in said first half of said cylindrical body, said second half of said cylindrical body being formed with a retaining recess, said cover being further formed with a retaining ring that surrounds said second half of said cylindrical body, and a retaining protrusion that protrudes radially and outwardly from said retaining ring, said rope-rewinding member being in the form of a spiral spring, being disposed between said retaining ring and said second half of said cylindrical body, and having an inner end that is secured to said retaining recess in said second half of said cylindrical body, and an outer end that is secured to said retaining protrusion of said cover.

4. The rope-operated actuator of claim 3, wherein said cover has a connecting part that is formed with a rope-confining member which defines a first rope-directing channel having an outlet end, said rope-operated actuator further comprising a rope-guiding member that includes a hollow cylindrical part and a frusto-conical part that extends and that diverges outwardly from said cylindrical part, said hollow cylindrical part being connected to said connecting part of said cover and defining a second rope-directing channel that is in spatial communication with said outlet end of said first rope-directing channel and that is aligned with said first rope-directing channel so as to cooperate with said first rope-directing channel to form a continuous rope-guiding channel that extends in a tangential direction relative to said spool wheel.

* * * * *